US005722329A

United States Patent [19]

Weng

[11] Patent Number: 5,722,329

[45] Date of Patent: Mar. 3, 1998

[54] WALL FLOWER SUPPORT STRUCTURE

[76] Inventor: Jung-Yi Weng, 1F, No. 1, Lane 11, ChingMing Street, Taipei, Taiwan

[21] Appl. No.: 783,828

[22] Filed: Jan. 13, 1997

[51] Int. Cl.[6] ..... A47B 5/00

[52] U.S. Cl. ..... 108/47; 108/152

[58] Field of Search ..... 108/47, 153, 180, 108/46, 152; 211/90, 87, 88, 182, 186; 248/208, 214, 235

[56] References Cited

U.S. PATENT DOCUMENTS

| | | | |
|---|---|---|---|
| 1,224,127 | 5/1917 | Bartlett | 108/47 X |
| 1,316,031 | 9/1919 | Hartig | 108/152 X |
| 1,854,987 | 4/1932 | Fradl | 108/47 |
| 2,865,432 | 12/1958 | Dearing | 108/47 X |
| 2,966,272 | 12/1960 | MacKenzie | 108/47 |
| 3,111,297 | 11/1963 | Conner | 108/152 X |
| 4,848,610 | 7/1989 | Lai | 108/152 X |
| 4,850,282 | 7/1989 | Postic | 108/47 |

FOREIGN PATENT DOCUMENTS

| | | | |
|---|---|---|---|
| 176311 | 12/1935 | Switzerland | 108/47 |

*Primary Examiner*—Jose V. Chen

*Attorney, Agent, or Firm*—Notaro & Michalos P.C.

[57] ABSTRACT

A wall flower support structure includes a first bar having fit into each end thereof a connector to connect with a second bar extending in a direction normal to the first bar in a fit engagement manner. Each of the second bars has a slot co-extensive therewith to receive therebetween support plates which form a platform for supporting flower pots. An end post extends from each of the connectors, and has two spaced openings to receive two legs of a U-shaped side rail member. An end plate is fixed to the free end of each of the second bars to contact the legs of the side rail member. An L-shaped anchoring member has a first leg extending through an opening of the end plate and set a spacing between the end plate and a second leg of the anchoring member for accommodating a wall therebetween. A fastening device is provided to secure the support structure to the wall. A front rail member with decorative pattern is releasably secured to the first bar.

13 Claims, 3 Drawing Sheets

WALL FLOWER SUPPORT STRUCTURE

FIELD OF THE INVENTION

The present invention relates generally to a structure to support flower pots along a wall, such as a balcony parapet, and in particular to such a structure comprising ready-to-change ornaments to provide versatile appearance.

BACKGROUND OF THE INVENTION

Growing flowers is a very common activity and hobby for urban people. However, in a crowded city, space is very limited so that it sometimes needs to place the flower pots along for example the parapet of a balcony. To place the flower pots along the balcony parapet requires a structure to support the flower pots. Such a support structure may be an integral part of the building or it may be externally attached to the balcony parapet. The externally attached support structure is usually made of for example aluminum, stainless steel or shaped metal frame which are pre-manufactured in factory sites as several large pieces and then assembled and together at the installation sites mostly by means of welding and non-releasably fastening device. Such a support structure is fixed and not allowed to be modify by the users themselves.

It is thus desirable to provide a user-modifiable wall-attached flower support structure which are assembled by bolting the parts thereof together so as to allow the user to replace the original ornaments with new ones as desired.

SUMMARY OF THE INVENTION

The principal object of the present invention is to provide a user modifiable wall-attached flower support structure wherein the parts thereof may be assembled together with simple hand tools and no welding is needed so as to allow a user to assemble by oneself and to allow the user to replace the ornaments thereof with new designs as desired.

Thus, in accordance with the present invention, there is provided a wall-attached flower support structure comprising a first bar having fit into each end thereof a connector to connect with a second bar extending in a direction normal to the first bar in a fit engagement manner. Each of the second bars has a slot co-extensive therewith to receive therebetween support plates which forms a platform for supporting thereon flower pots. An end post is fixed to and extends upright from each of the connectors, having two spaced openings formed thereon to receive two legs of a U-shaped side rail member in a direction substantially parallel with the second bar. An end plate is fixed to the free end of each of the second bars to be in contact engagement with the legs of the side rail member and secured thereto. An L-shaped anchoring member has a first leg extending through an opening formed on the end plate and location adjustably received within an interior passage formed inside the upper leg of the side rail member to define a spacing between the end plate and a second leg of the anchoring member for accommodating a wall therebetween. A fastening device is provided to secure the support structure to the wall. A front rail member with decorative pattern formed thereon is releasably secured to the first bar by means of screws to allow a user to change with new front rail having new decorative pattern.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
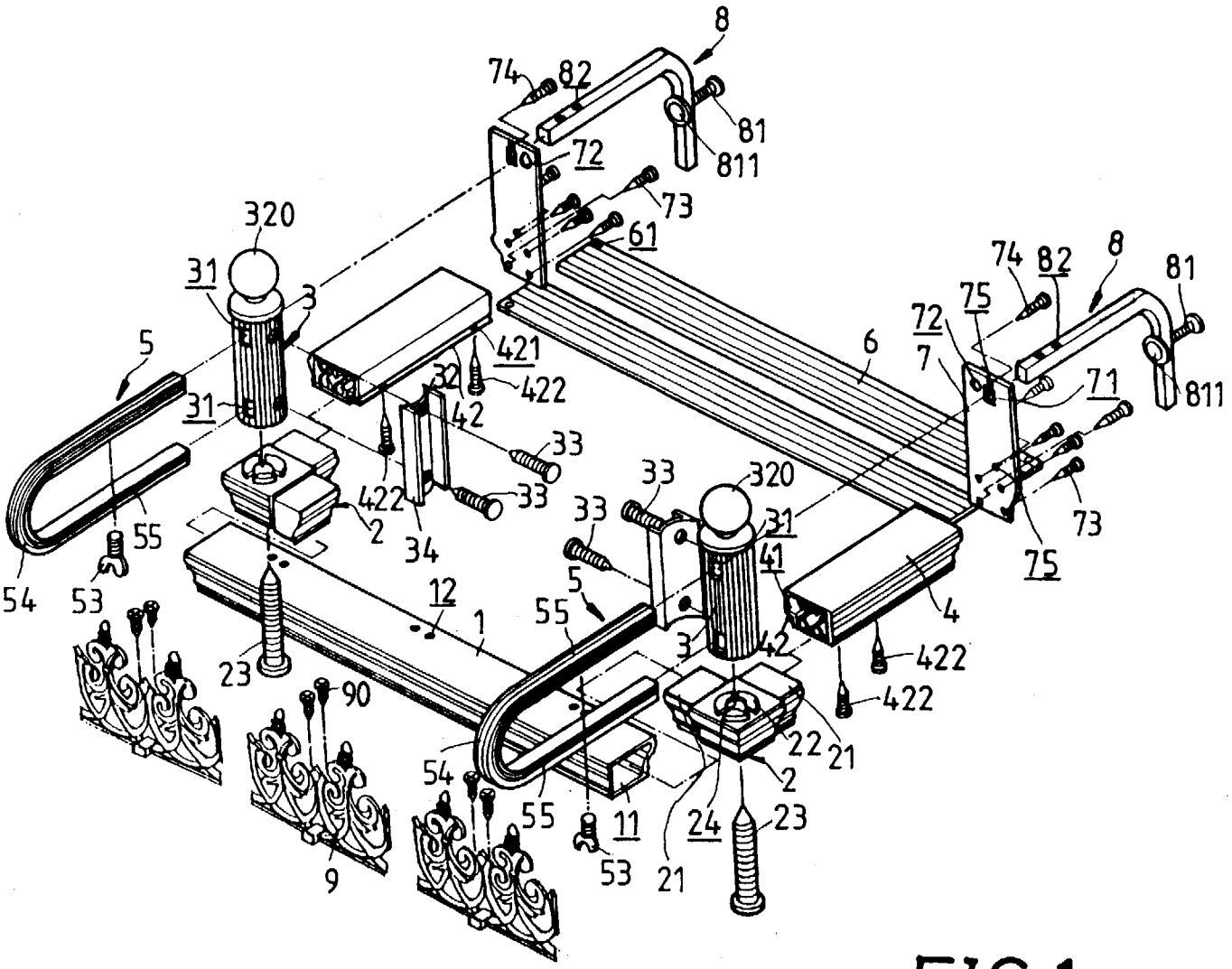
FIG. 1 is an exploded perspective view showing a wall flower support structure in accordance with the present invention.
Figure 2:
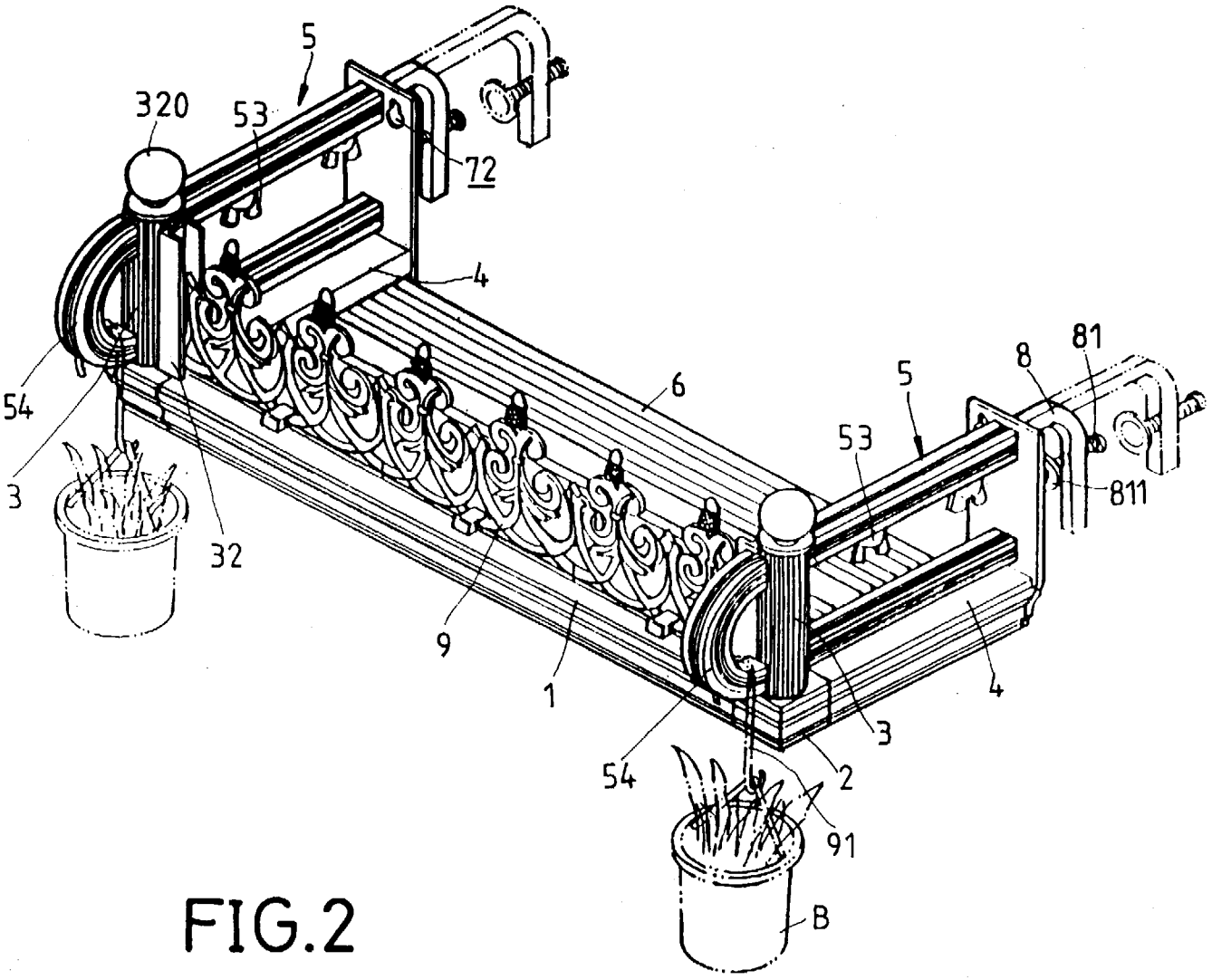
FIG. 2 is a perspective view showing the wall flower support structure in accordance with the present invention.
Figure 3:
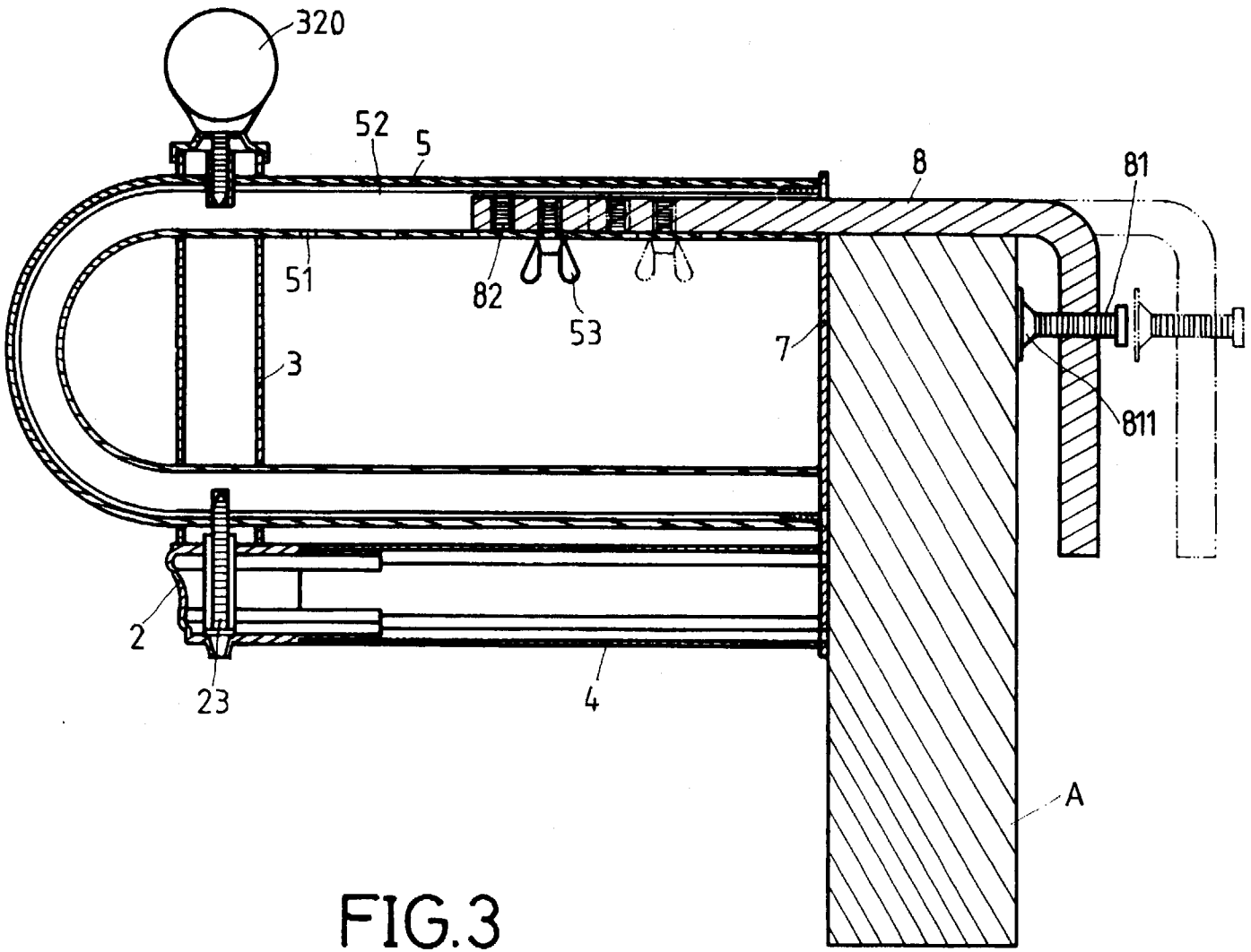
FIG. 3 is a cross-sectional view of the wall flower support structure in accordance with the present invention.

With reference to the drawings and in particular to FIGS. 1 and 2, which show a wall flower support structure in accordance with the present invention, the wall flower support structure of the present invention comprises an elongated first bar 1 which is intended to be arranged to be substantially parallel with a wall A, such as a balcony parapet, as shown in FIG. 3, and will also be referred to as "parallel bar" herein and two second bars 4 of a predetermined axial length which are connected at a first axial end thereof to each of two longitudinal ends of the parallel bar 1 by means of a connector member 2 so as to be opposite to and spaced from each other, forming a U shape. An opposite, second axial end of each of the second bars 4 is to be in contact engagement with the wall A, as shown in FIG. 3, with an end plate 7 (to be further described) sandwiched therebetween and substantially perpendicular to the wall A. Thus, the second bars 4 will also be referred to as "perpendicular bars" herein.

To make the perpendicular bars 4 perpendicular to the wall A and thus perpendicular to the parallel bar 1, the connector members 2 comprise two extension sections 21 substantially normal to each other and sized to be respectively receivable within end holes 11 and 41 formed on the respective longitudinal end of the parallel bar 1 and the first axial end of the respective perpendicular bar 4.

The connector members 2 are also provided with a central hole 24 extending therethrough in a direction substantially normal to both the parallel bar 1 and the perpendicular bars 4 to receive therein a screw 23 whose function will be further discussed. On top side of the connector members 2, positioning means comprising a plurality of raised arc sections 22 arranged along a circular track around the central hole 24 is provided to be received within an open lower end of an end post 3.

The end post 3, in the embodiment illustrated, comprises a cylindrical body of a predetermined axial length (height) having an open lower end sized to fit over the arc sections 22 for positioning the end post 3 on the connector member 2 and extending therefrom in a direction substantially normal to both the parallel bar 1 and the perpendicular bars 4. The screw 23 that extends through the central hole 24 of the connector body runs into the open lower end of the end post 3 to secure the end post 3 on the connector member 2.

Preferably, each of the end posts 3 comprises an ornamental, such as a spherical member 320, provided on the upper end thereof for decoration purpose. The spherical member 320 may be connected to the end post 3 by means of threading as shown in FIG. 3.

Each of the end posts 3 is also provided with two openings 31 extending diametrically through the cylindrical body thereof, preferably in a direction substantially parallel with the respective perpendicular bar 4, and axially spaced from but aligned with each other. The openings 31 will be further discussed.

Each of the perpendicular bars 4 comprises a slot 42 co-extensive therewith to be opposite to each other for receiving therebetween at least one support plate 6 of which two opposite side edges are slidably received and supported within the slots 42. In the embodiment illustrated, there are two support plates 6 received within the slots 42, but it is apparent that there may be different number of support plates to be received within the slots 42, provided the overall dimension of the support plates in the direction of the perpendicular bars 4 is not greater than the length of the perpendicular bars 4. Each of the slots 42 is provided with a plurality of holes 421 through which screws 422 extend to engage holes 61 provided on the support plates 6 so as to secure the support plate 6 on and between the perpendicular bars 4.

The support plates 6 provide a platform on which flower pots (not shown) may be placed.

An end plate 7 is fixed to the second axial end of each of the perpendicular bars 4 by means of for example screws 73 to be substantially opposite to the respective end post 3. The end plate 7 has a height above the perpendicular bars 4 so as to have an opening 71 formed thereon which is substantially aligned with the upper one of the openings 31 formed on the end post 3 and having a size corresponding to or slightly smaller than the opening 31.

A U-shaped side rail member 5 comprises two legs 55 connected at an end with an arc section 54 to be spaced from each other a distance substantially corresponding to the distance between the two openings 31 of the end post 3. The legs 55 have a cross-sectional dimension and shape receivable within and extendible through the openings 31. The free ends of the legs 55 of the rail member 5 that extend through the openings 31 of the end post 3 are in contact engagement with the respective end plate 7 and secured thereto by means of two screws 74 extending through two holes 75 formed on the end plate 7 to respectively engage one of the legs 55.

The arc section 54 of the side rail member 5 defines a spacing with the respective end post 3 through which a hanging device 91, see FIG. 2, may be optionally received to hang a flower pot B under the flower support structure of the present invention.

Alternatively, each of the end plates 7 may be provided with an opening 72 through which the handing device may be optionally received to hang the flower pot thereon.

The upper one of the legs 55 of the side rail member 5 is provided with an interior passage 52, see FIG. 3, extending to the free end thereof so that when the side rail member 5 is secured to the end plate 7, the passage 52 is substantially aligned with the opening 71 of the end plate.

An L-shaped anchoring member 8 having a first second dimensioned to be extendible through the opening 71 of the end plate 7 and slidably receivable within the interior passage 52 of each of the side rail members 5 so as to make the distance between a second leg of the L-shaped anchoring member 8 and the end plate 7 adjustable to accommodate a wall A of different thickness therebetween, see FIG. 3, preferably with the first leg of the anchoring member 8 supported on top of the wall A, as shown in FIG. 3, but not necessarily to be so.

The first leg of the anchoring member 8 is provided with a plurality of spaced inner-threaded holes 82 and correspondingly, the upper leg 55 of the side rail member 5 is provided with a plurality of holes 51 selectively through one of which a bolt 53, preferably a butterfly bolt for being ready to be tightened with finger directly, is received. The bolt 53 selectively engages one of the inner-threaded holes 82 of the anchoring member 8 to secure the anchoring member 8 to the rail member 5 and to selectively fix the distance between the second leg of the anchoring member 8 and the end plate 7.

Fastening means, such as an adjusting screw 81 with a swivel head 811 facing the end plate 7, is provided on the second leg of the anchoring member 8 to secure the flower support structure of the present invention to the wall A.

A front rail member 9 is provided and secured between the two end posts 3. To hold the front rail member 9 between the two end posts 3, each of the end posts 3 is provided with a channel member 32 which is fixed to the end post 3 with for example screws 33. The channel member 32 comprises two spaced walls 34 defining therebetween a slot for receiving a lateral side edge of the front rail member 9.

In addition, the parallel bar 1 may also be provided with screw holes 12 to receive and engage screws 90 that extend through holes formed on bottom side or base of the front rail member 9 so as to secure the front rail member 9 to the parallel bar 1.

The front rail member 9 may be made as a single piece or alternatively, the front rail member 9 may be composed of a plurality of segments, as shown in FIG. 1 with each of the segments being individually screw-secured to the parallel bar 1 and also interconnected to each other by means of for example screws and a small piece of plate bridging between two adjacent segments. Both arrangements provide the same function.

Preferably, the front rail member 9 is provided with scroll ornamental or ornamental of other designs for decoration purpose. In accordance with the present invention, the screw-secured front rail member 9 may be readily replaced with a new one having different ornamental patterns so as to provide a versatile appearance of the flower support structure in accordance with the present invention.

Although a preferred embodiment has been described to illustrate the present invention, it is apparent that changes and modifications in the specifically described embodiment can be carried out without departing from the scope of the invention which is intended to be limited only by the appended claims.

What is claimed is:

1. A flower support structure adapted to be attached to a wall, comprising:

a support frame comprising:

a first bar having two hollow ends, a pair of connector members each having two extensions extending along two directions that are not co-linear, one of the extensions of one of the connectors being removably fitted into one hollow end of the first bar and one of the extensions of the other connector being removably fitted into the other hollow end of the first bar, a pair of second bars each having a first hollow end into which a second one of the extensions of the connector members is fit to connect the second bars to each of the ends of the first bar so as to have the second bars opposite to each other, and an opposite second end of each second bar being adapted to abut against the wall, each of the second bars comprising a slot co-extensive therewith and opposite to each other, and at least one support plate having two opposite side edges respectively slidably and removably fitted within the slots of the second bars to be supported thereon, fasteners being provided to secure the support plate to the second bars;

a rail structure comprising:

an end post of a predetermined axial length mounted to a top side of each of the connector members with an axial end thereof and axially extending in a direction substantially normal to the first bar and the second bars, each end post comprising two openings extending therethrough in a direction substantially parallel with one of the second bars and axially spaced from each other at a predetermined distance, an end plate secured to a second end of each of the second bars to extend in a direction substantially parallel with and opposite to each end post, each end plate comprising an opening substantially in alignment with one of the openings of one of the end posts that is remote from the connector member to which the one of the end posts is connected, a U-shaped side rail member comprising two legs spaced from each other at a distance corresponding to the axial distance between the openings of each of the end posts to be removably fitted and extendible through the openings so as to have free ends of the legs in contact engagement with the respective end plate and an arc section connecting the two legs together, one of the legs that extends through the openings of the end post that is remote from the respective connector member and corresponding to the opening of the end plate comprising an interior passage in alignment with the opening of the end plate to define an interior channel, and a front rail member releasably mounted to the first bar; and anchoring means comprising:

an L-shaped member having a first leg slidably fitted within the interior channel of each of the U-shaped side rail members through the opening of the respective end plate to have a second leg of the L-shaped member substantially parallel with and spaced from the end plate at a distance adapted to accommodate the wall therebetween, the distance between the end plate and the second leg of the L-shaped member being adjustable by moving the first leg of the L-shaped member relative to the side rail frame, securing means being provided on the first leg of the L-shaped member to location-adjustably secure the L-shaped member to the respective side rail member, and fastening means comprising an adjusting screw rotatably mounted on the second leg of the L-shaped member with a swivel head mounted on an end of the adjusting screw facing the end plate to manually operate to tightly secure the wall between the respective end plate and the swivel head and thus fix the flower support structure on the wall.

2. The flower support structure as claimed in claim 1, wherein each end post comprises an ornamental mounted on an axial top end thereof opposite to the connector member.

3. The flower support structure as claimed in claim 1, wherein each of the end posts comprises a channel mounted thereto to be opposite to each other for receiving and holding two lateral side edges of the front rail member therein.

4. The flower support structure as claimed in claim 1, wherein the front rail member comprises a base having holes formed thereon to receive screws therethrough to engage corresponding holes formed on the first bar and thus releasably securing the front rail member to the first bar.

5. The flower support structure as claimed in claim 1, wherein the front rail member comprises a plurality of segments which are individually releasably fixed to the first bar and interconnected with each other with a plate bridging between two adjacent segments and screws securing the plate to the two adjacent segments.

6. The flower support structure as claimed in claim 1, wherein each of connector members comprises a positioning member raised on the top thereof to be received within a lower open end of the respective end post.

7. The flower support structure as claimed in claim 1, wherein each of the connector members comprises a through hole extending in the direction of the respective end post to receive a screw therethrough for engaging a lower end of the end post and thus securing the end post to the connector member.

8. The flower support structure as claimed in claim 1, wherein the fasteners that secure the support plate to the second bars comprise screws that extend through holes formed on the second bars and holes formed on the support plate.

9. The flower support structure as claimed in claim 1, wherein each of the side rail members comprises a plurality of holes formed along the leg that comprises the interior channel to communicate with the interior channel and wherein the first leg of each of the L-shaped members comprises at least one inner-threaded hole formed thereon, a bolt being provided to selectively extend through one of the holes of the side rail member to engage the inner-threaded hole to location-adjustably secure the L-shaped member to the side rail member.

10. The flower support structure as claimed in claim 9, wherein the bolt comprises a butterfly head.

11. The flower support structure as claimed in claim 9, wherein the first leg of the L-shaped member comprises a plurality of inner-threaded holes to be selectively engaged by the bolt.

12. The flower support structure as claimed in claim 1, wherein each of the front rail members comprises an ornamental pattern thereon.

13. The flower support structure as claimed in claim 1, wherein each of the legs of each of the side rail members is secured to the end plate by means of a screw.

* * * * *